US010131410B2

(12) United States Patent
Blume et al.

(10) Patent No.: US 10,131,410 B2
(45) Date of Patent: Nov. 20, 2018

(54) HOME STRUCTURE WITH INTEGRATED BOAT SLIP AND LIFT

(71) Applicant: IN-HOUSE DOCKING CONCEPTS, LLC, Naples, FL (US)

(72) Inventors: Craig D. Blume, Naples, FL (US); Peter Takos, Naples, FL (US); Ronald E. Peterson, Marco Island, FL (US)

(73) Assignee: IN-HOUSE DOCKING CONCEPTS, LLC, Naples, FL (US)

( * ) Notice: Subject to any disclaimer, the term of this patent is extended or adjusted under 35 U.S.C. 154(b) by 0 days.

(21) Appl. No.: 15/381,719

(22) Filed: Dec. 16, 2016

(65) Prior Publication Data

US 2017/0174297 A1 Jun. 22, 2017

Related U.S. Application Data

(60) Provisional application No. 62/269,462, filed on Dec. 18, 2015, provisional application No. 62/297,391, filed on Feb. 19, 2016.

(51) Int. Cl.

| | |
|---|---|
| ***B63C 3/06*** | (2006.01) |
| ***B63C 3/12*** | (2006.01) |
| ***E04H 1/02*** | (2006.01) |
| *B63C 1/08* | (2006.01) |
| *E02D 29/02* | (2006.01) |

(52) U.S. Cl.

CPC ..... *B63C 3/06* (2013.01); *B63C 3/12* (2013.01); *E04H 1/02* (2013.01); *B63C 1/08* (2013.01); *E02D 29/02* (2013.01)

(58) Field of Classification Search

CPC .... B63C 3/00; B63C 3/06; B63C 3/12; B63C 15/00; B63C 1/08; E02D 29/02; E02D 29/0225; E02D 29/0233

USPC ..... 52/173.1, 174; 414/678

See application file for complete search history.

(56) References Cited

U.S. PATENT DOCUMENTS 47,501 A * 4/1865 Turner ..... B63C 3/06 114/48

1,270,659 A * 6/1918 Ravier ..... E02B 3/066 405/262

(Continued)

OTHER PUBLICATIONS

"https://web.archive.org/web/20130812172203/http://thesteepletimes.com/opulence-splendour/five-of-the-best-boathouses/" (Year: 2013).*

(Continued)

*Primary Examiner* — Joshua J Michener
*Assistant Examiner* — Matthew J Gitlin
(74) *Attorney, Agent, or Firm* — Knobbe, Martens, Olson & Bear LLP

(57) ABSTRACT

A home structure can have an integrated nautical garage and boat slip. The boat slip can be defined entirely under the home such that the boat can be located entirely under the home within the residential setback envelope for the home. The nautical garage can include a lift mechanism for lifting the boat out of the water. The lift mechanism can have a no profile deck that aligns substantially flush with the floor of the nautical garage when the boat is fully raised. The nautical garage can have a roll down shutter and/or door that can be closed to close off an opening of the nautical garage (e.g., once the boat has been navigated into the nautical garage). The boat slip can optionally be defined by a U-shaped culvert.

17 Claims, 21 Drawing Sheets

(56) References Cited

U.S. PATENT DOCUMENTS 1,423,884 A * 7/1922 Rush ..... E02B 3/066 405/218
2,110,253 A * 3/1938 Nedden ..... E02D 29/02 405/259.1
2,338,110 A * 1/1944 Harris ..... B63B 9/00 405/5
2,384,464 A * 9/1945 Harris ..... B63C 1/08 405/5
2,384,616 A * 9/1945 Harris ..... B63C 1/08 405/5
3,073,125 A * 1/1963 Pearlson ..... B63B 9/00 405/3
3,362,172 A * 1/1968 Rutter ..... B63B 9/00 405/3
3,802,205 A * 4/1974 Dickinson ..... E02B 3/066 405/285
4,640,214 A * 2/1987 Bruns ..... B63B 35/44 114/258
4,643,618 A * 2/1987 Hilfiker ..... E02D 29/0241 405/284
4,655,646 A * 4/1987 Babcock ..... E02D 29/0266 405/262
4,686,920 A * 8/1987 Thomas ..... B63C 3/06 114/45
4,690,588 A * 9/1987 Berger ..... E02B 3/066 405/262
4,804,299 A * 2/1989 Forte ..... E02D 29/0241 405/262
4,911,585 A * 3/1990 Vidal ..... E02D 29/0283 405/284
4,976,211 A * 12/1990 Reinhardt ..... B63C 3/06 114/44
5,641,242 A * 6/1997 Riviere ..... B63C 3/06 114/263
5,655,850 A * 8/1997 Holmgren ..... B63C 1/02 114/48
5,692,857 A * 12/1997 Ness ..... B63C 3/06 114/44
5,865,005 A * 2/1999 Cataldo ..... E02D 29/025 405/284
6,491,473 B2 * 12/2002 Veazey ..... B63B 3/04 405/16
7,547,159 B1 * 6/2009 Warters ..... B63C 3/06 114/44
7,603,959 B1 * 10/2009 Veazey ..... B63B 3/08 114/263
7,896,582 B2 * 3/2011 Chouery ..... E02D 29/02 405/262
9,789,942 B2 * 10/2017 Rosenberg ..... B63C 15/00
2002/0176767 A1 * 11/2002 Gisselberg ..... B63C 3/06 414/261
2010/0239371 A1 * 9/2010 Brown ..... E02C 5/00 405/3
2013/0008098 A1 * 1/2013 Freitag ..... E02D 29/0241 52/166
2014/0147208 A1 * 5/2014 Devitt ..... B63C 3/06 405/3
2016/0288888 A1 * 10/2016 Peterson ..... B63C 3/08

OTHER PUBLICATIONS

"https://www.youtube.com/watch?v=Lrtm5TR0U64" Grand Bahama Yatch Club Aug. 6, 2008 (Year: 2008).*

Mircea Moro, You know you're rich when . . . , the Odd Desk, 2013, http://odesk.ro/you-know-youre-rich-when/, obtained Dec. 14, 2016.

http://www.itokin.com/musee/trippin/blog/assets_c/2013/03/50-thumb-500xauto-4803.ipq, obtained Dec. 14, 2016.

Yolen-Cohen, Malerie, See the Adirondacks Like Your Grandaddy Did (With Better Food and Bedding), the Huffington Post, Aug. 8, 2013 http://www.huffingtonpost.com/malerie-yolencohen/see-the-adirondacks_b_3720836.html, obtained Dec. 14, 2016.

Adirondack Architecture, Wikipedia, Feb. 9, 2009, https://en.wikipedia.org/wiki/Adirondack_Architecture, obtained Dec. 14, 2016.

1140 Vista Dr., realtor.com, Jan. 3, 2013 http://www.realtor.com/realestateandhomes-detail/1140-Vista-Dr_Bay-Harbor_MI_49770_M39758-29743, obtained Dec. 16, 2016.

* cited by examiner

HOME STRUCTURE WITH INTEGRATED BOAT SLIP AND LIFT

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. This application claims the benefit of U.S. Provisional Application Nos. 62/269,462, filed Dec. 18, 2015 and 62/297,391 filed Feb. 19, 2016, the entirety of both of which is incorporated by reference and should be considered a part of this specification.

BACKGROUND

Field

The present application relates to a home structure, and more particularly, to a home structure with an integrated boat slip, nautical garage and lift.

Description of the Related Art

Boat garages that are standalone structures separate from the home structure are known, where the garage includes a boat slip into which the boat can be navigated. Such boat garages are used, for example, in lake waterfronts. In some designs, the boat garage can have a boat lift system to lift the boat out of the water while in the garage.

The home structure is usually set back a distance from the accessory boat garage, for example on lakes. Seaside and canal homes can have a dock at which boats are anchored or raised on as necessary by a lift, but again the home structure is set back a distance from the dock. Both of these require users to exit their home to embark and disembark the boat, which exposes them to the weather. Additionally, boat house designs used in lake waterfronts are unsuitable for salt waterfront designs, due to the corrosive nature of salt on the construction materials used for boat garages on lakesides. Further, many local and state ordinances prohibit accessory covered boat garages to be constructed in salt water access communities because, among other things, they obstruct views, present navigation hazards and are potential risks in adverse weather conditions.

SUMMARY

There is a need for an improved design for a boat garage that addresses the problems indicated above with respect to existing designs.

In accordance with one embodiment, a home structure with an integrated nautical garage and boat slip is provided, where the boat slip lift and docking area is defined entirely under the home such that the boat can be located entirely under the home within the residential setback envelope for the home. The nautical garage can include a lift mechanism for lifting the boat out of the water. The lift mechanism can have a no profile deck that aligns substantially flush with the floor of the nautical garage when the boat is fully raised. The nautical garage can have a roll down door and/or shutter that can be closed to close off an opening of the nautical garage (e.g., once the boat has been navigated into the nautical garage). Advantageously, the home structure with the integrated nautical garage and boat slip described herein can be used even in communities with local or state ordinances that would otherwise prohibit boat houses.

In one embodiment, the boat slip can be defined by a cantilevered sea wall design. In another embodiment, the boat slip can be defined by a seawall that is coupled to a deadman via tiebacks. In still another embodiment, the boat slip can include a cantilevered sea wall as well as one or more walls coupled to a deadman via tiebacks.

In accordance with one embodiment, a residential home is provided that comprises a structure set back from a water's edge and defining one or more living spaces, and a nautical garage integrated with the structure and accessible via at least one of the living spaces without a user having to exit the structure. The nautical garage comprises a boat slip set back from a water's edge and at least partially under the nautical garage, the boat slip defined by one or more seawalls and sized to receive a boat therein, and a lift mechanism disposed in the boat slip and configured to be actuated to move a boat into and out of water while in the boat slip.

In accordance with another embodiment, a residential home is provided that comprises a structure set back from a water's edge and defining one or more living spaces, and a nautical garage integrated with the structure and accessible via at least one of the living spaces without a user having to exit the structure. The nautical garage comprises a boat slip set back from a water's edge and at least partially under the nautical garage, the boat slip defined by a left sea wall, a right seawall and a rear sea wall, the boat slip sized to receive a boat therein. The nautical garage further comprises a lift mechanism disposed in the boat slip and configured to be actuated to move a boat into and out of water while in the boat slip, a no profile deck disposed under the lift mechanism that substantially aligns with a floor of the nautical garage when the boat is raised out of the water while in the boat slip.

DETAILED DESCRIPTION

Figure 1:
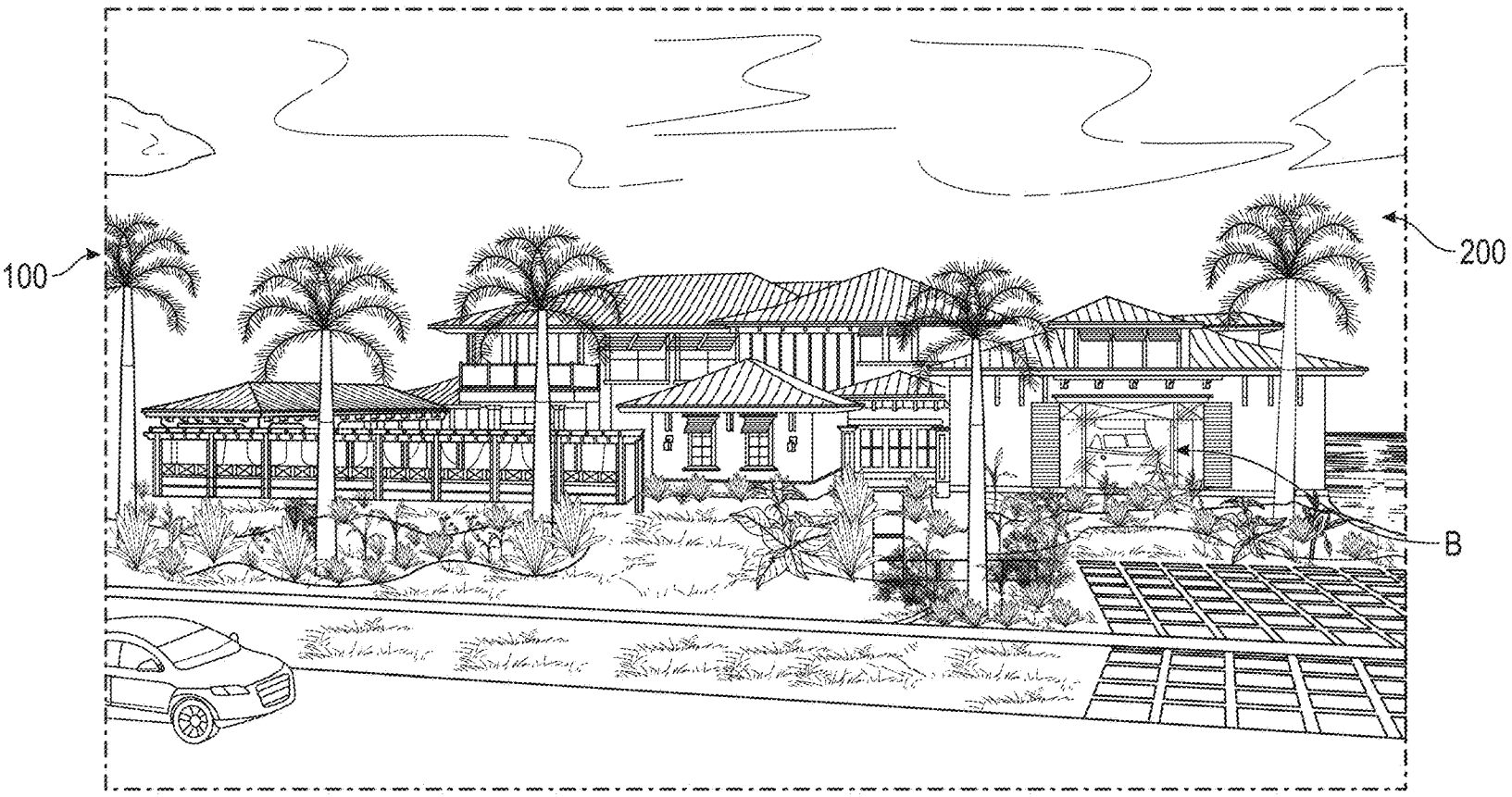
FIG. 1 is a schematic drawing showing one embodiment of a home structure with an integrated boat slip and nautical garage.
Figure 2:
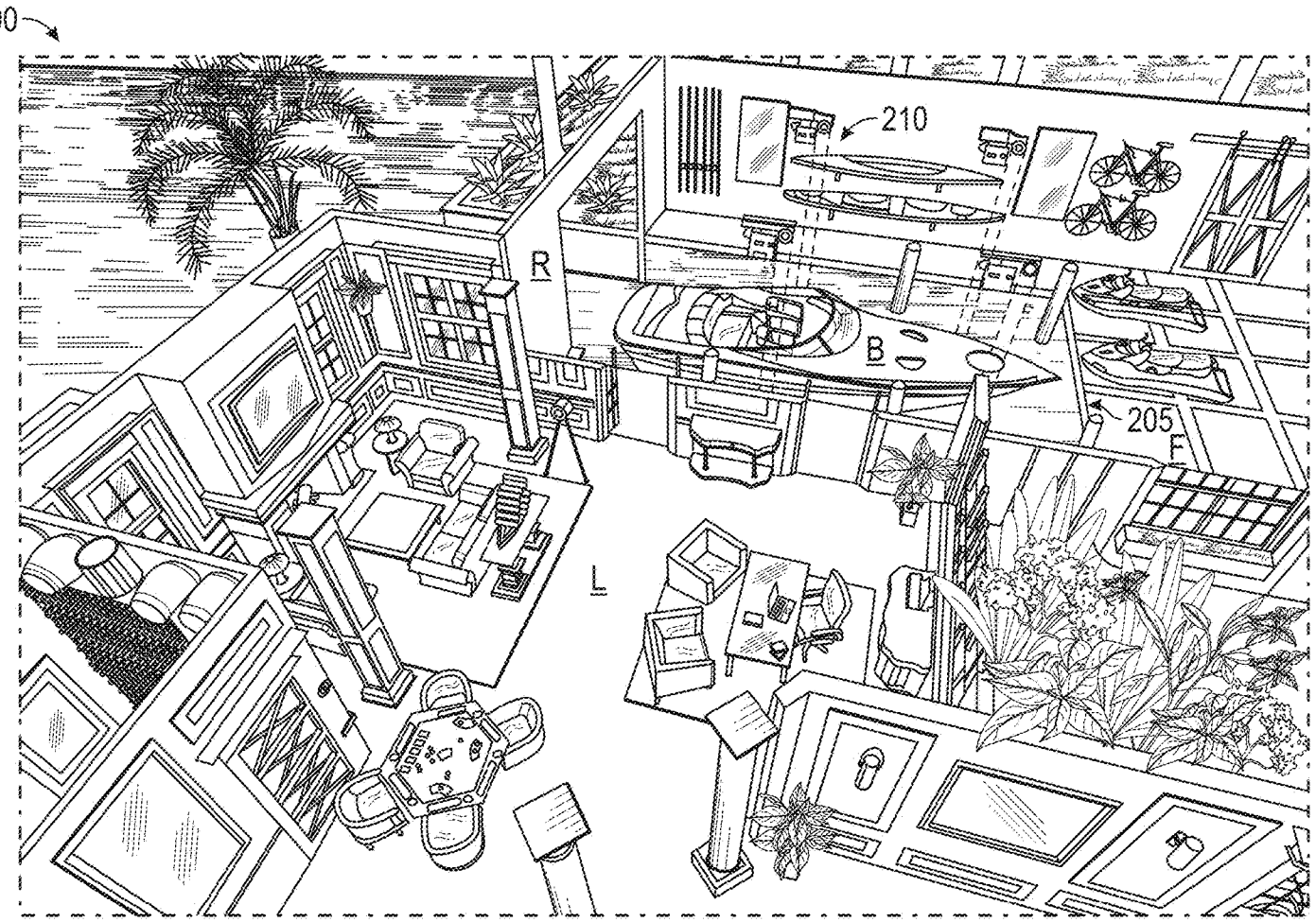
FIG. 2 is a schematic drawing showing a view of a first floor of a home structure with an integrated boat slip (with the second floor and roof of the home structure removed).

FIG. 1 shows a schematic drawing showing one embodiment of a home structure 100 with an integrated nautical garage 200 into which a boat B can be navigated. FIG. 2 shows a partial view of a first floor of the home structure 100, which shows the integrated nautical garage 200 accessed via one or more doors from a living space L (e.g., living room). The garage 200 can have a boat slip 205, a floor F and a rear opening R through which the boat B can access the boat slip 205. The nautical garage 200 can have a lift mechanism 210 (which can be coupled to two or more walls (or to the ceiling) or attached to independent pilings of the nautical garage 200. The lift mechanism 210 can be selectively (e.g., via user operated controls) operated to lift the boat B out of the water once in a desired location in the slip 205. In another embodiment, the lift mechanism 210 can be automatically operated to lift the boat B out of the water, for example, when the boat B is sensed (by one or more sensors) to be in the desired location in the sip 205. Accordingly, the boat slip 205 and lift mechanism 210 can be entirely under the home structure within the residential setback envelope.

With continued reference to FIG. 2, in one embodiment, the integrated nautical garage 200 can include a no profile deck under the boat B that is lowered along with the boat B by the lift mechanism 210, and that is raised along with the boat B by the lift mechanism 210. The no profile deck can align (e.g., sit flush with) the floor F of the garage 200 so as to provide an even surface with the floor F of the garage 200. Additionally, though not shown, a roll down shutter and/or door can be included to close off the rear opening R of the garage 200 once the boat B is in the boat slip 205 to fully enclose the nautical garage 200. In one embodiment, the roll down shutter and/or door can abut against the no profile deck once the deck has been raised by the boat lift mechanism 210.

Figure 2A:
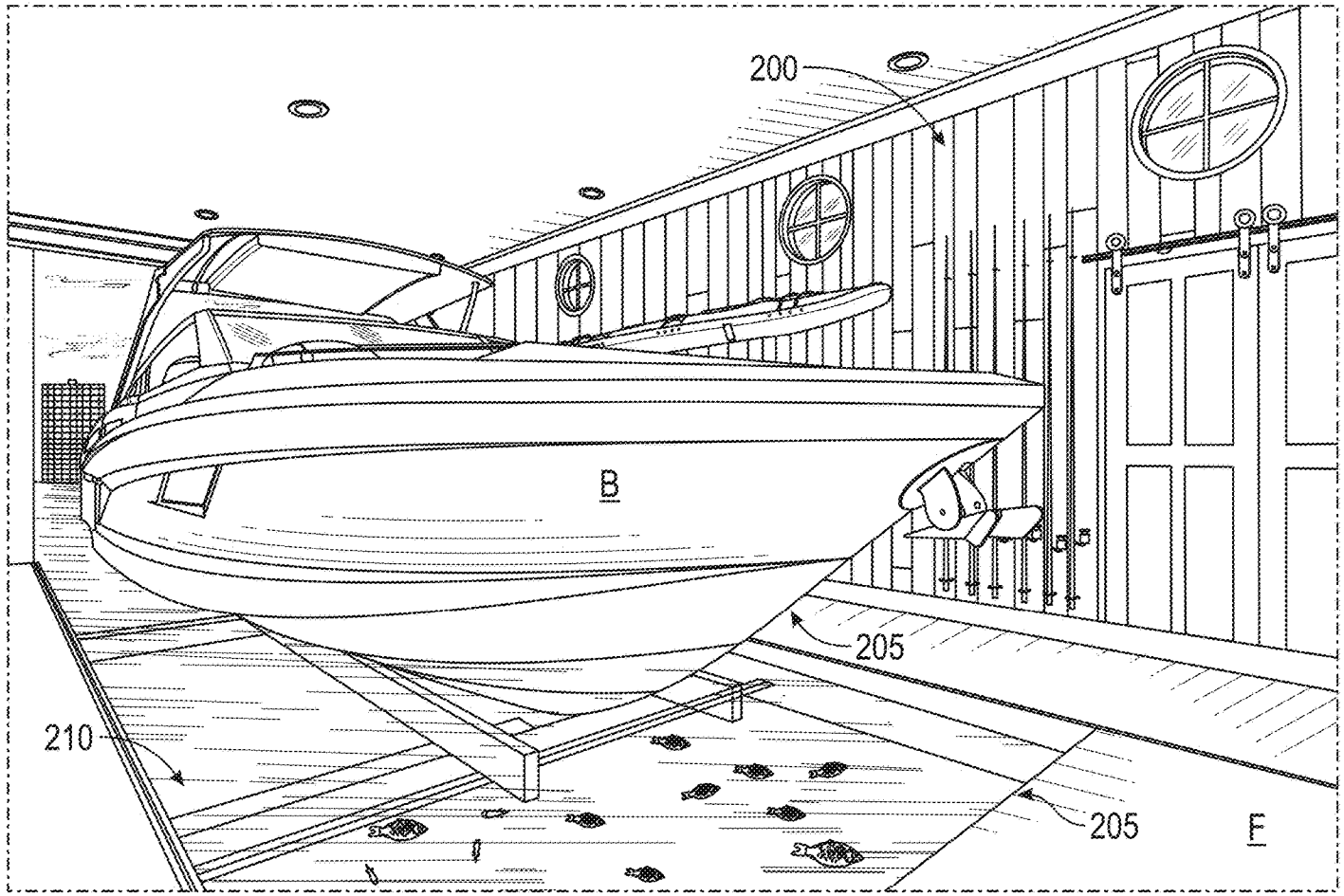
FIG. 2A is a schematic drawing showing a view of one embodiment of a boat slip and nautical garage integrated into a home structure.

FIG. 2A shows another embodiment of a nautical garage 200 in which the boat B has been lifted out of the water by the lift mechanism 210. As discussed further below, the lift mechanism 210 can have brackets mounted to inner surfaces of the boat slip 205. Though not shown in FIG. 2A, as discussed above the nautical garage 200 can have a no profile deck that can align (e.g., sit flush with) the floor F of the garage 200 so as to provide an even surface with the floor F of the garage 200 when the boat B is lifted out of the water.

Figure 3:
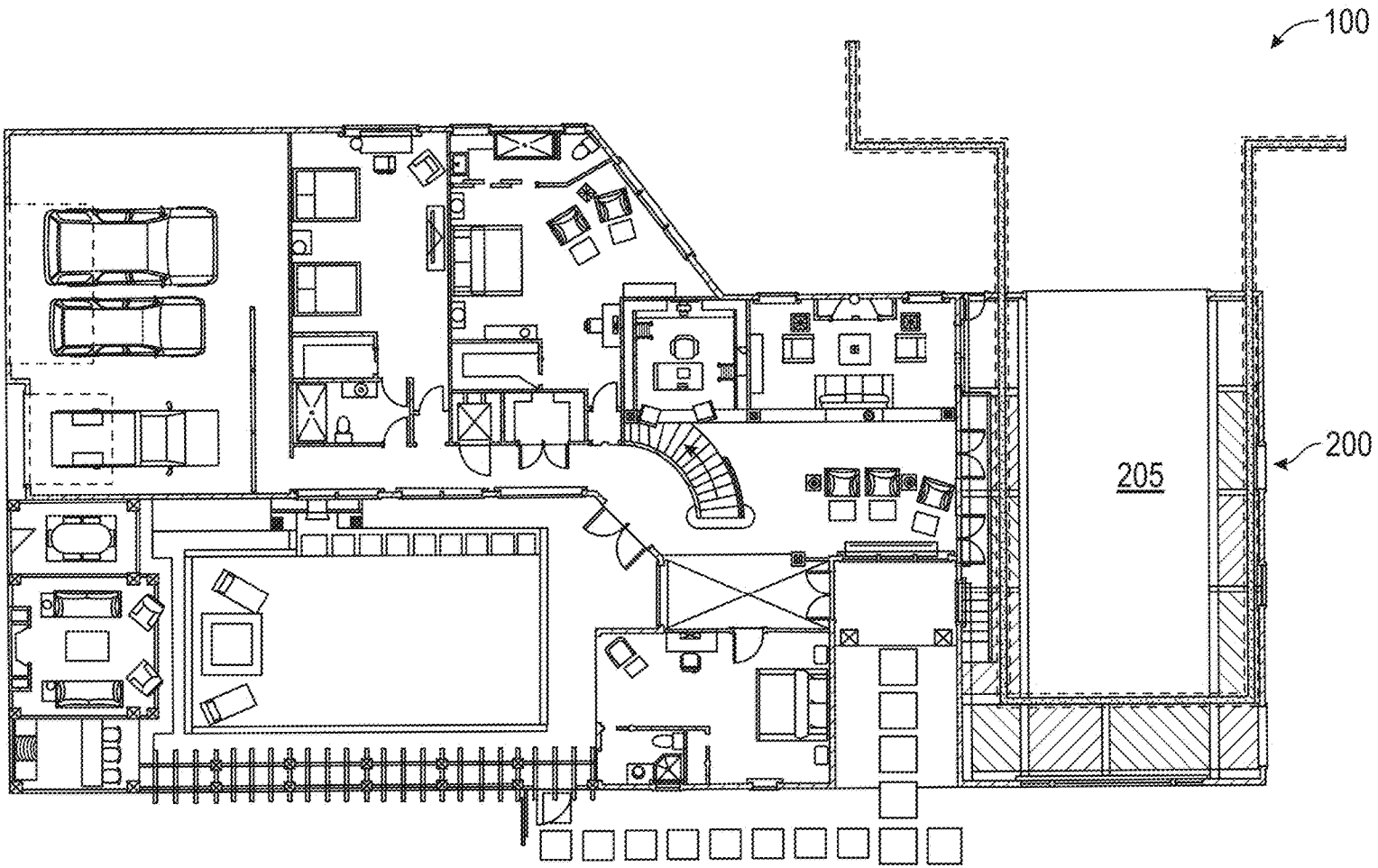
FIG. 3 is a scale drawing showing a plan view of a first floor of a home structure with an integrated boat slip and nautical garage.

FIG. 3 shows a plan view of a first floor of one embodiment of the home structure 100, showing living quarters on the left of the nautical garage 200 and boat slip 205. In other embodiments, the nautical garage 200 and boat slip 205 can be on the left hand side of the home structure 100, with the living quarters to the right of the nautical garage 200. In still another embodiment, the nautical garage 200 and boat slip 205 can be located between the left and right end of the home (e.g., in a center location), where living quarters are disposed on either side of the nautical garage 200 and boat slip 205.

Figure 4:
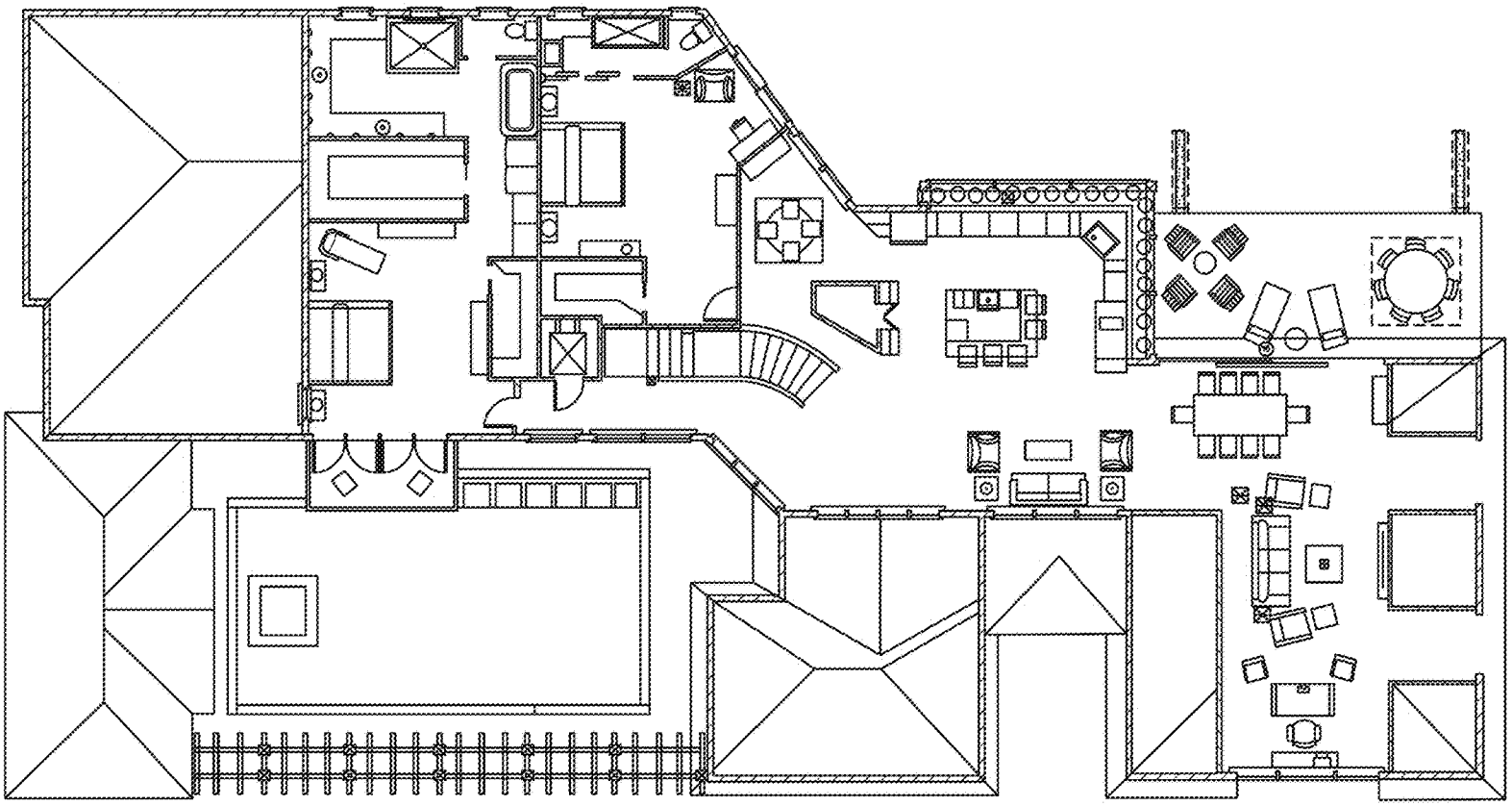
FIG. 4 is a scale drawing showing a plan view of a second floor of the home structure of FIG. 3 with the integrated boat slip and nautical garage.

FIG. 4 shows a plan view of a second floor of one embodiment of the home structure 100, showing living quarters above the nautical garage 200 and boat slip 205. In the illustrated embodiment, a living room and dining room can be on the second floor above the nautical garage 200 and boat slip 205. In one embodiment, the boat slip 205 can include a seawall system that is independent from the residential pilings/structure of the home structure 100. In another embodiment, the boat slip 205 can include a seawall system that is connected to the residential pilings/structure of the home structure 100 (e.g., such that it defines the ceiling of the nautical garage 200 and floor of second floor of home structure 100).

Figure 4A:
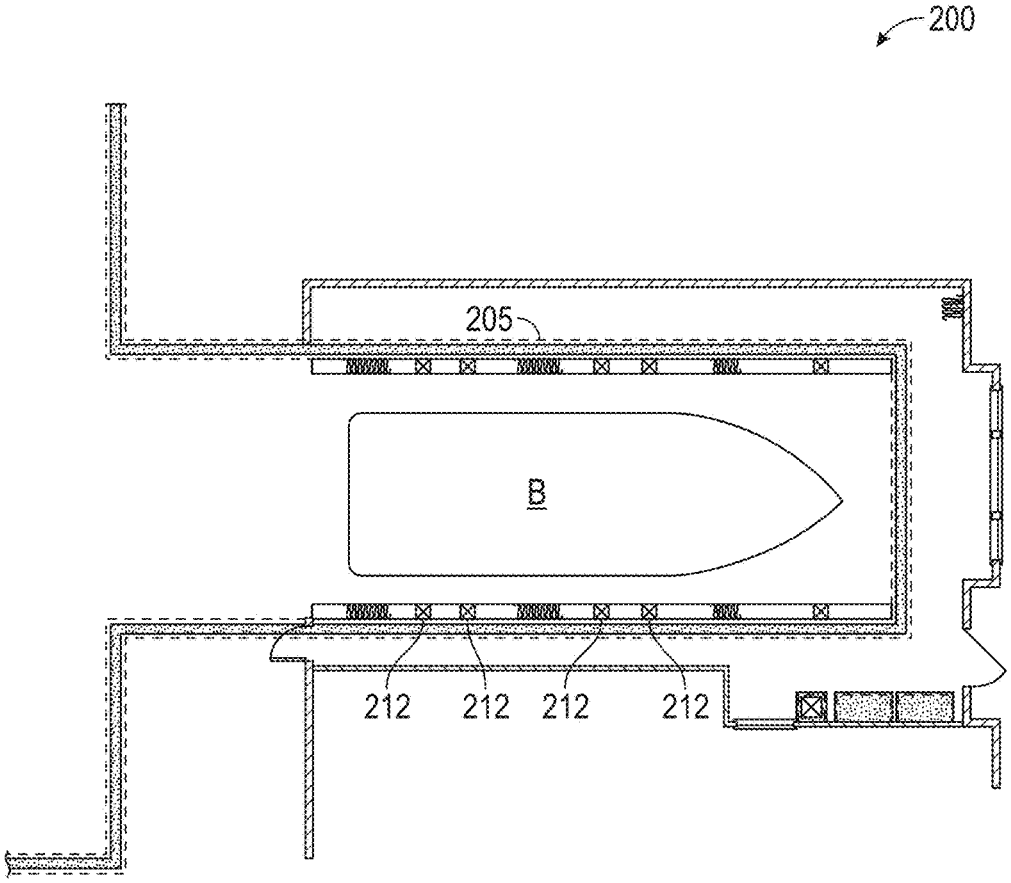
FIG. 4A is a schematic top plan view of one embodiment of a boat slip and nautical garage integrated into a home structure.
Figure 4B:
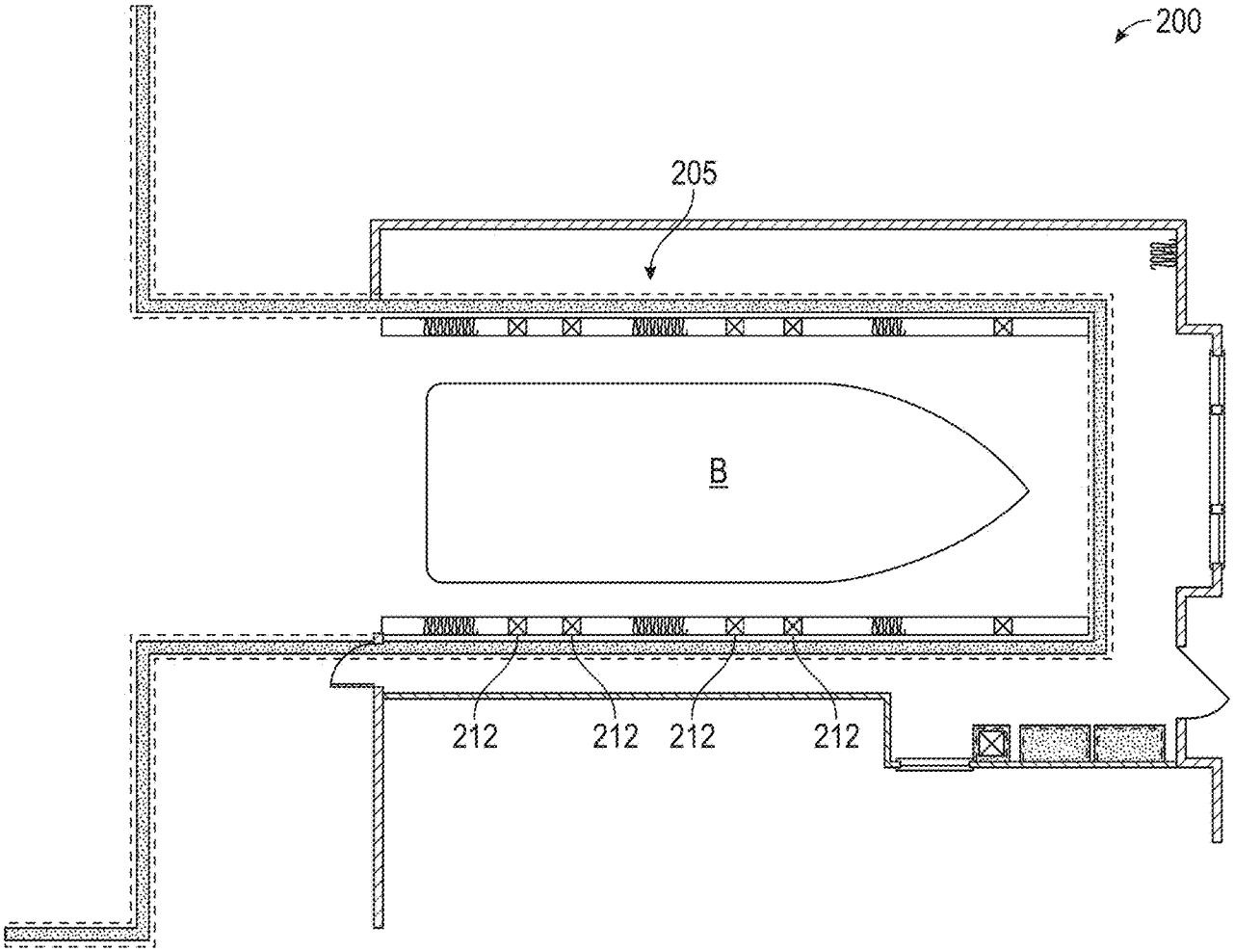
FIG. 4B is an enlarged view of the boat slip and nautical garage shown in FIG. 4A.

FIGS. 4A-4B show a top plan view of one embodiment of a nautical garage 200 and boat slip 205. In the illustrated embodiment, one or more support brackets 212 for the lift mechanism 210 can be anchored to the seawall that defines the sides of the boat slip 205. The lift mechanism 210 can be coupled to the support brackets 212 and can operate to lift the boat B into and out of the water.

Figure 5:
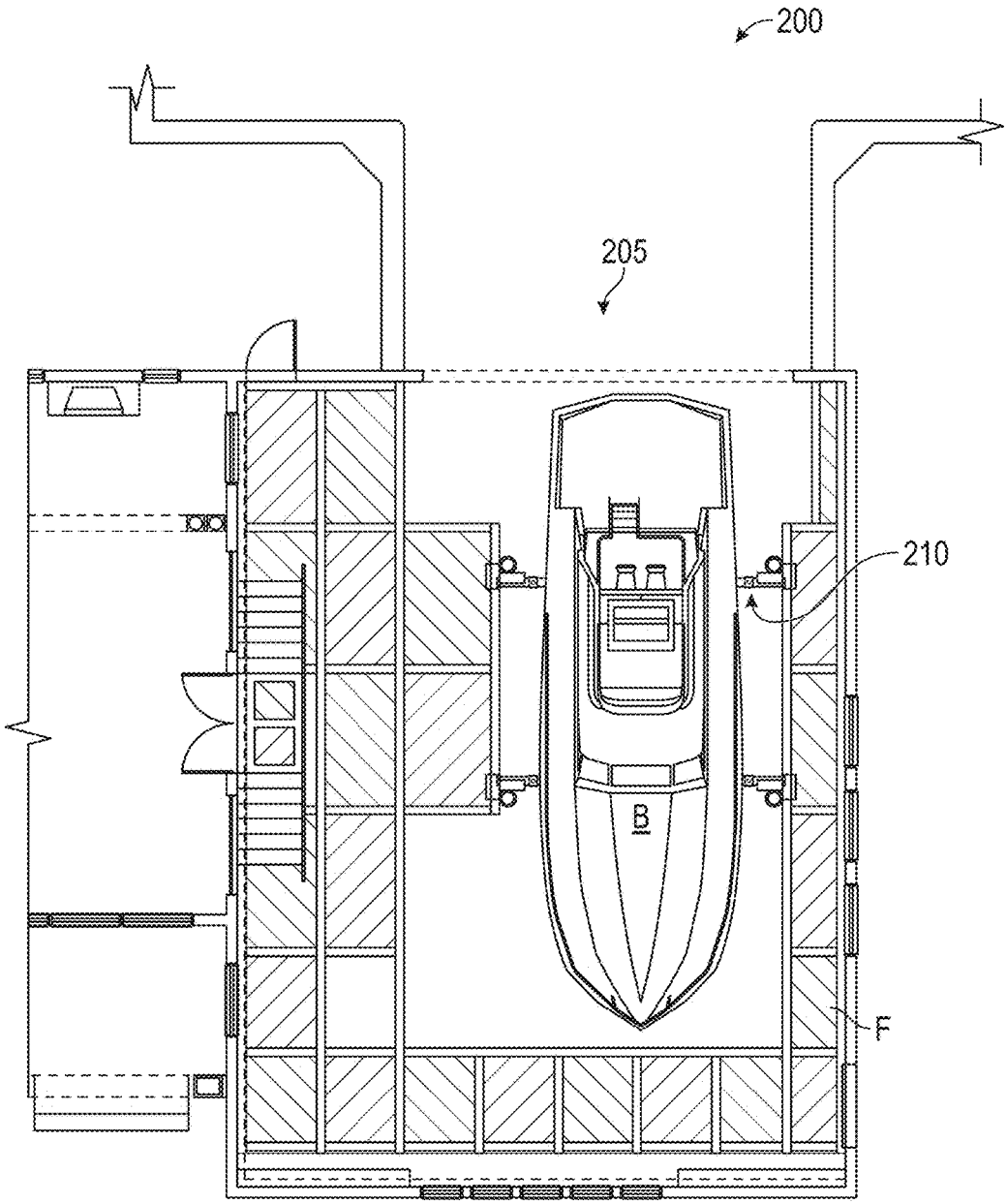
FIG. 5 is a scale drawing showing a top view of one embodiment of a nautical garage for a home structure with an integrated boat slip and nautical garage.

FIG. 5 is a top view of one embodiment of the nautical garage 200 with a boat slip 205 and a lift mechanism 210 for a boat B. Though not shown, as discussed above, a no profile deck can be disposed below the boat B, where the no profile deck aligns in a flush manner with the floor F of the nautical garage 200 when the boat B is in the fully raised position.

Figure 6:
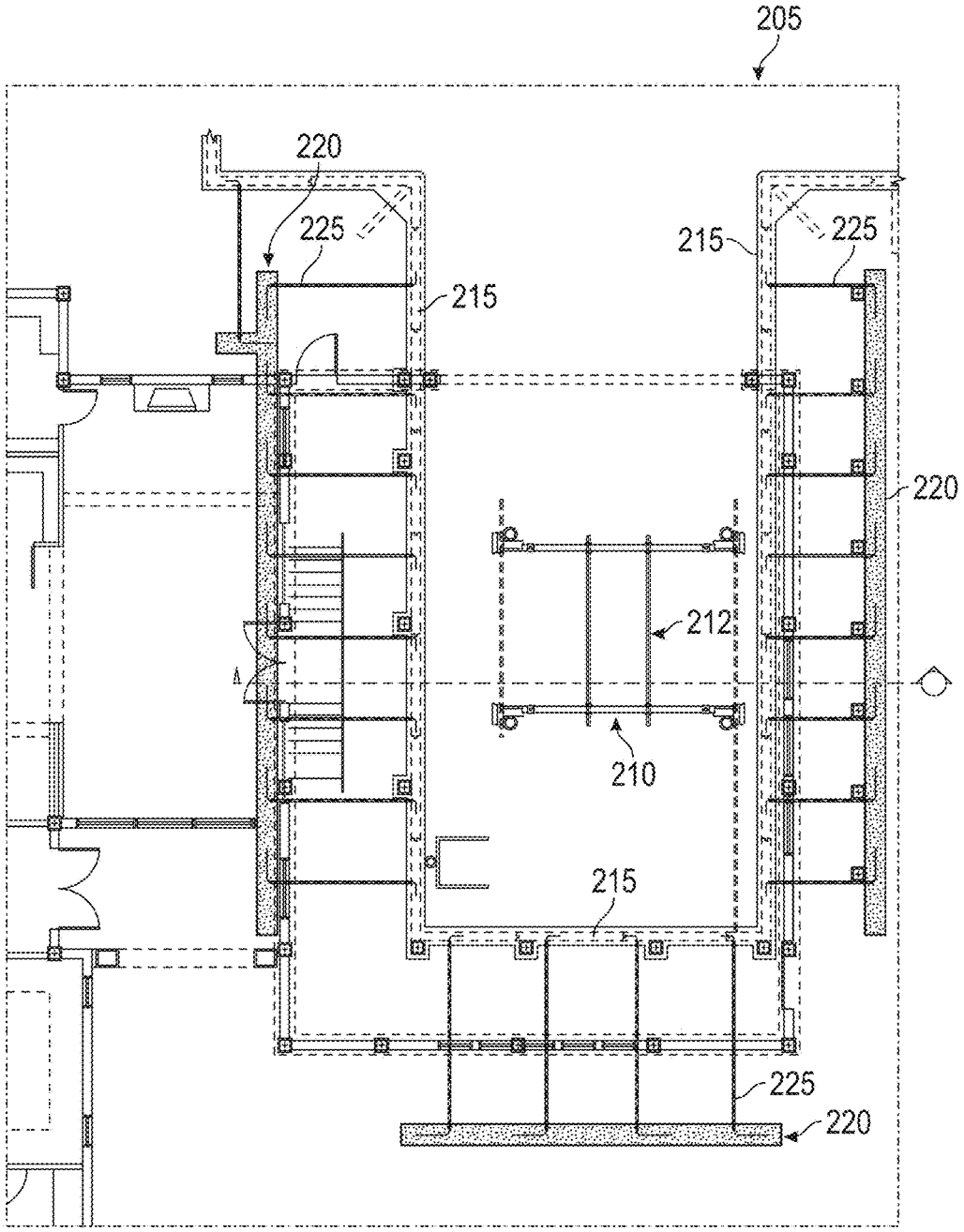
FIG. 6 is a scale drawing showing a top view of one embodiment of a nautical garage seawall design for use with the home structure with an integrated boat slip and nautical garage.
Figure 7:
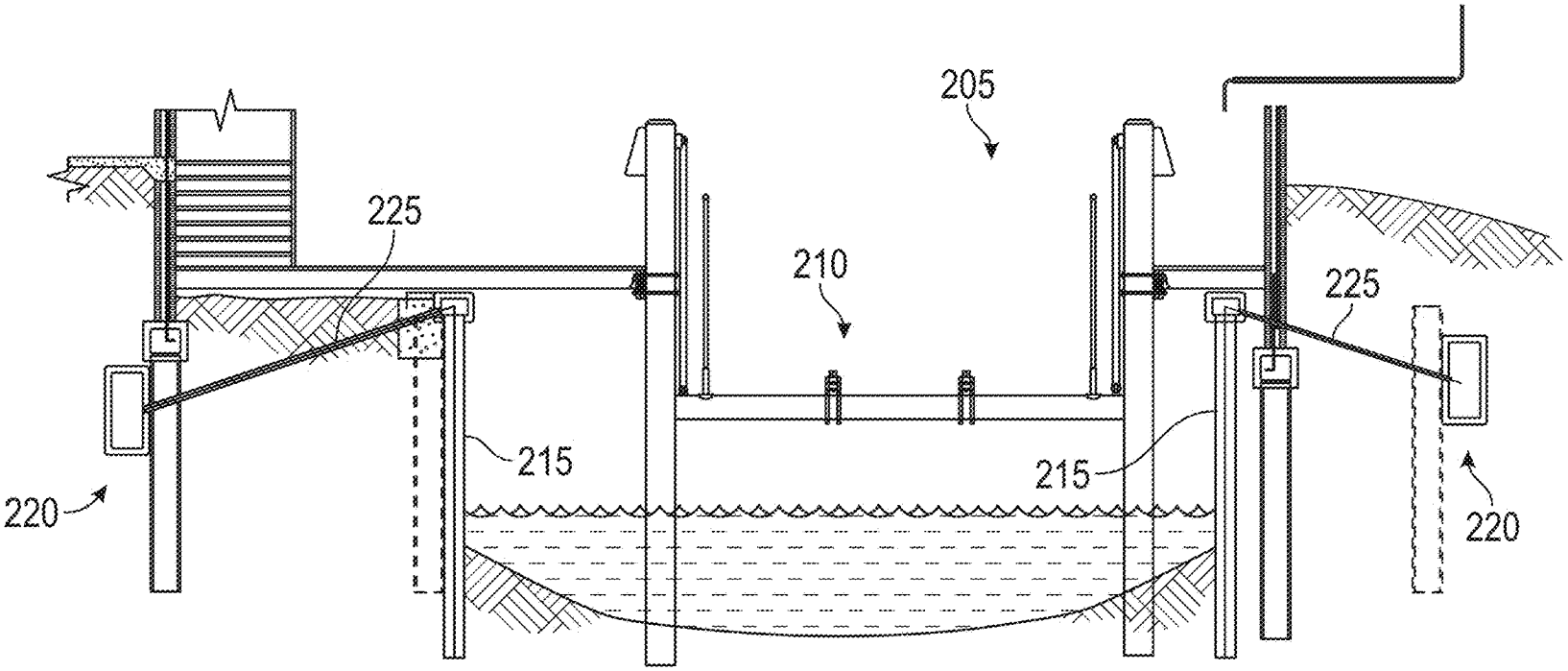
FIG. 7 is a scale drawing showing one embodiment of a boat lift for use with the home structure with an integrated boat slip and nautical garage.

FIG. 6 is a top view, and FIG. 7 is a front view, of one embodiment of a seawall 215 for the boat slip 205. In the illustrated embodiment, the seawall design includes tiebacks 225 (e.g., made of metal, such as steel) that connect the seawall 215 to a corresponding concrete deadman 220 for each portion that defines the boat slip 215. Also shown in FIGS. 6 and 7 is the lift mechanism 210, including rails 212 that can be disposed on either side of the centerline of the boat B hull prior to the lifting of the boat B into the nautical garage 200. In the illustrated embodiment, the boat slip 205 within the nautical garage 200 can have a width of about 24 feet and length of about 40 feet. Additionally, a width between pylons of the lift mechanism 210 can in one embodiment be about 16 feet (see FIG. 7). However, in other embodiments, the boat slip 205 can have other dimensions to accommodate a boat of a different size. In some embodiments, the boat slip 205 can have a width of about 19 feet or about 18 feet, and a length of about 55 feet, or about 60 feet.

Figure 8A:
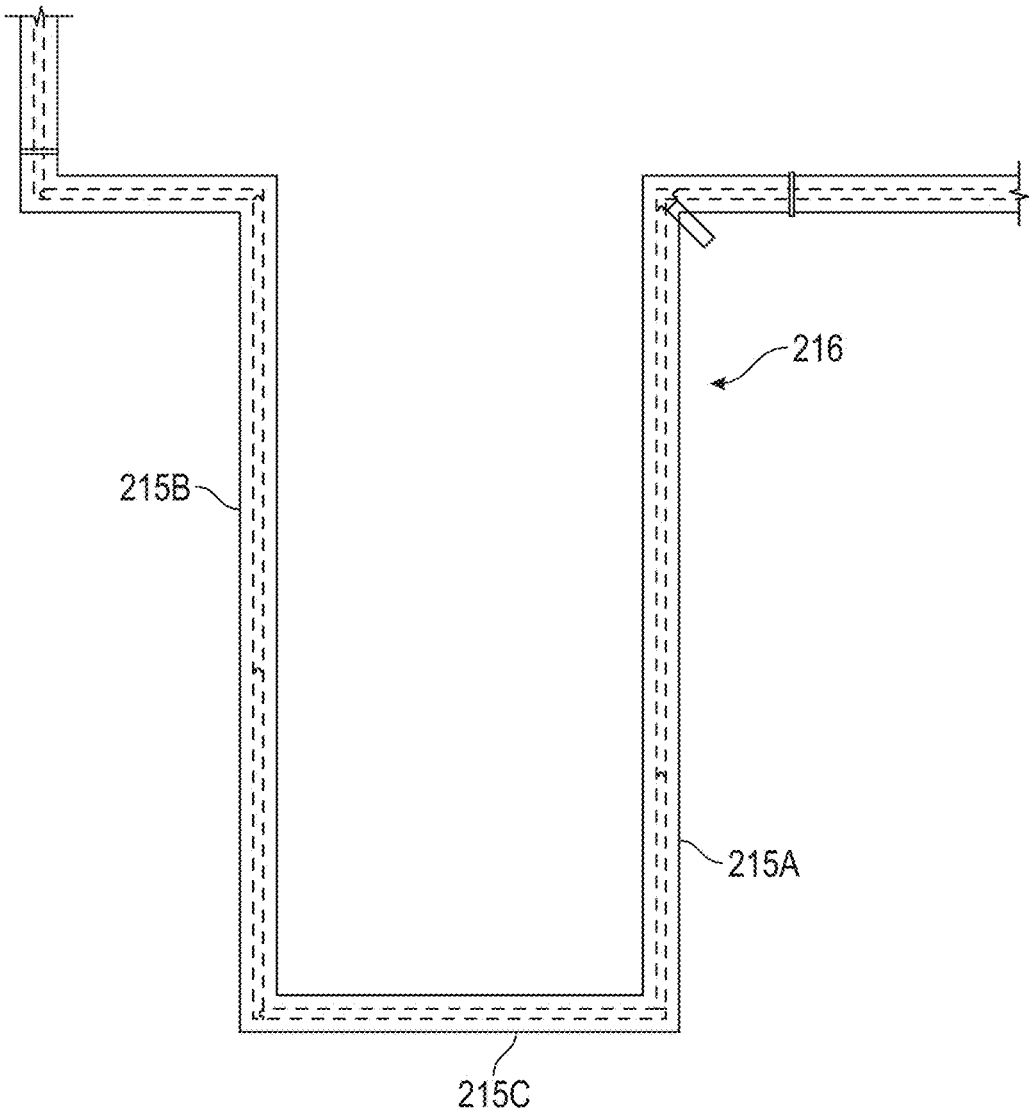
FIG. 8A is a scale drawing showing a top view of another embodiment of a nautical garage seawall design for use with the home structure with an integrated boat slip and nautical garage.
Figure 8B:
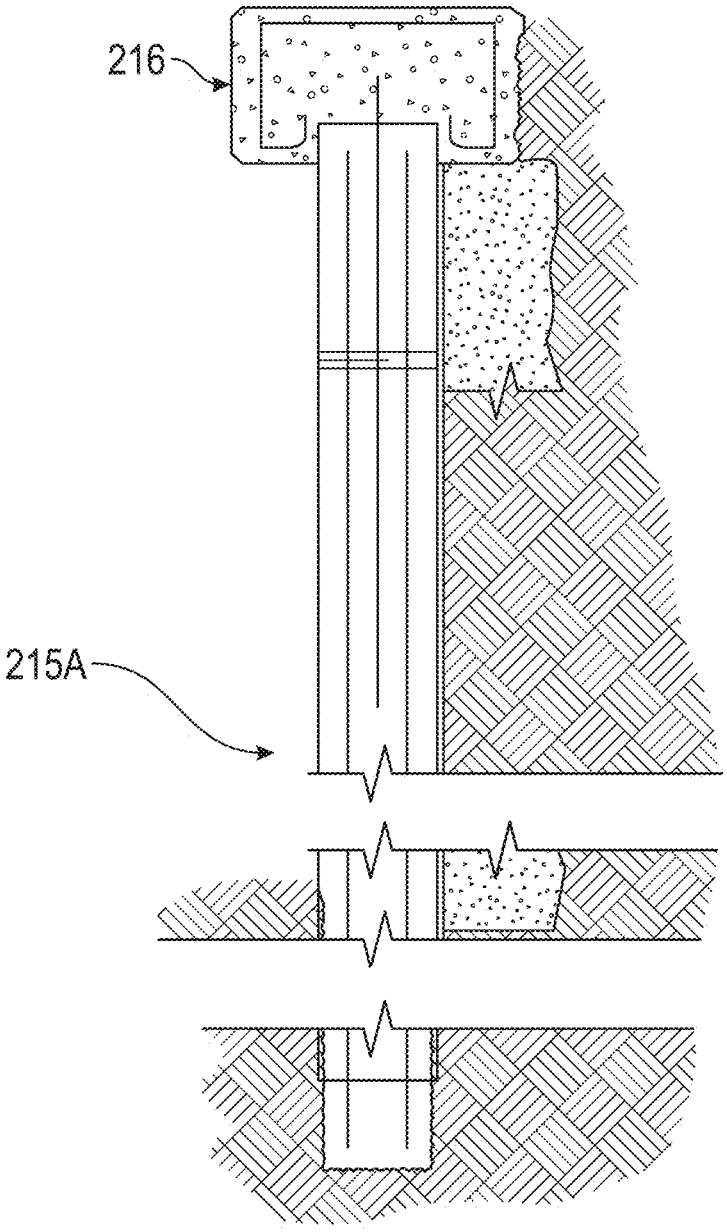
FIG. 8B is a scale drawing showing a sectional view of a cantilever seawall section of the nautical garage seawall design of FIG. 7A.
Figure 8C:
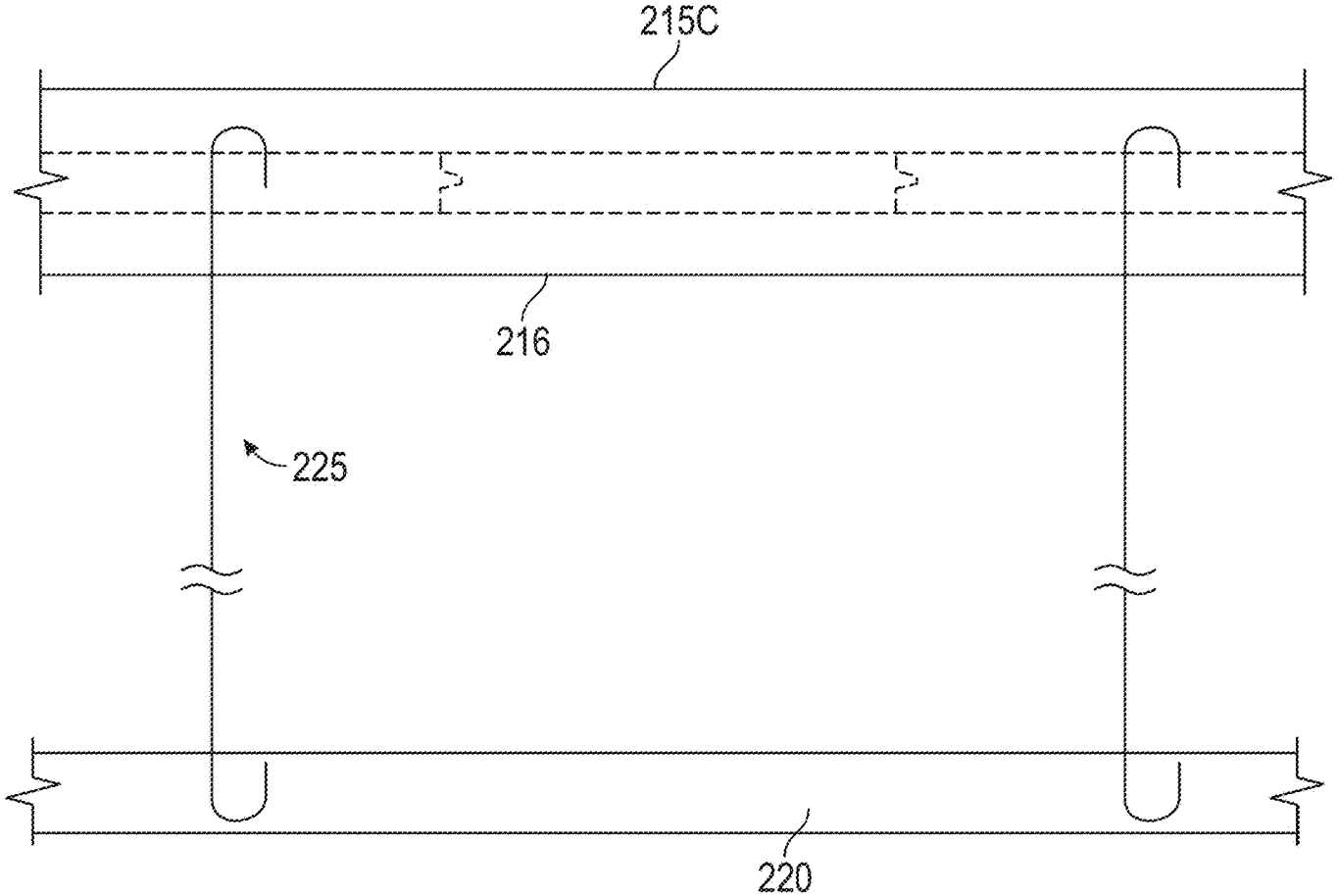
FIG. 8C is a scale drawing showing a tie-back seawall plan view for the nautical garage seawall design of FIG. 7A.
Figure 8D:
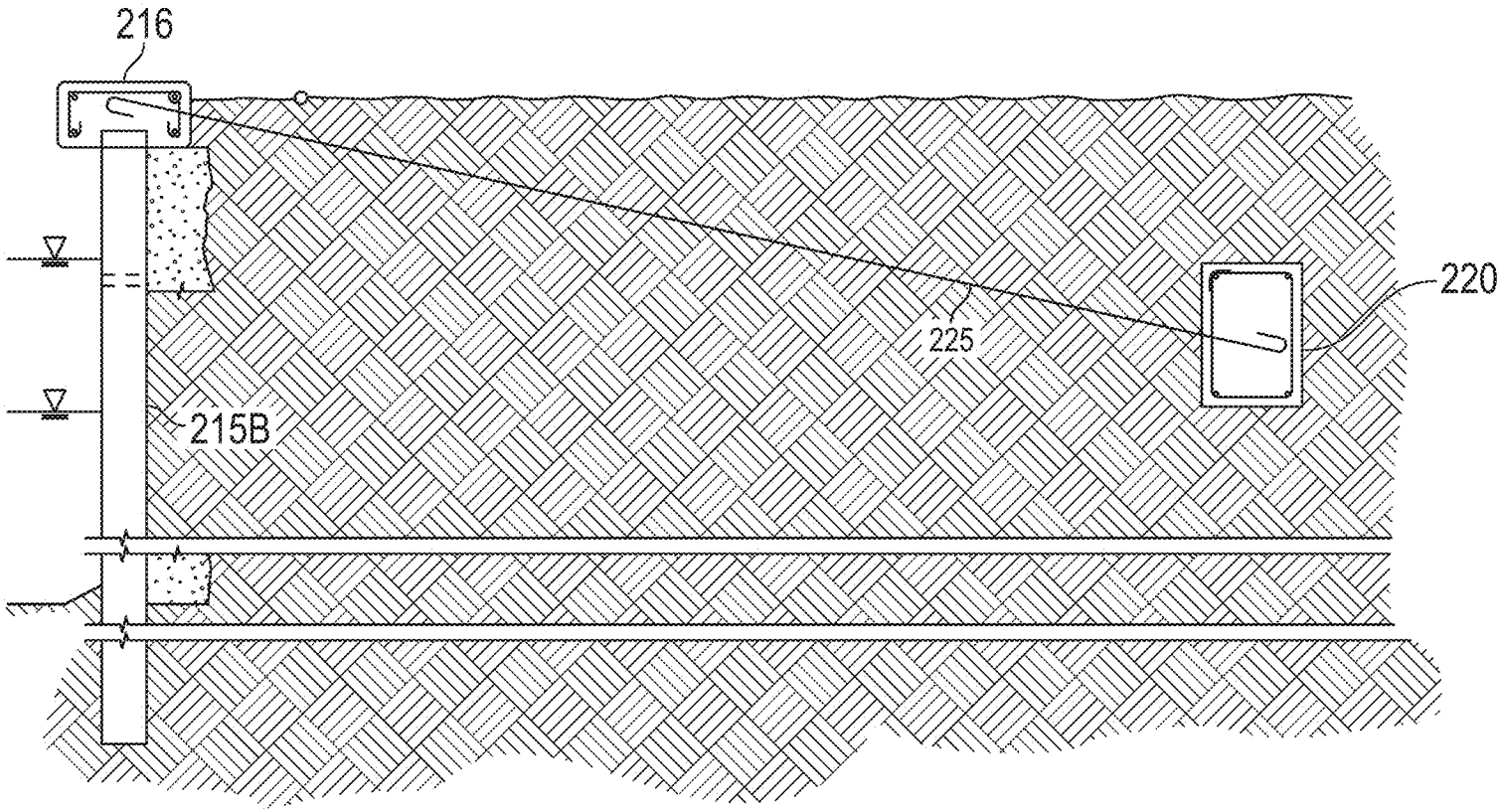
FIG. 8D is a scale drawing showing a tie-back retaining wall for the nautical garage seawall design of FIG. 7A.

FIGS. 8A-8D show another embodiment of a seawall design for the boat slip 205 of the nautical garage 200. In the illustrated embodiment, the seawall is a cantilevered seawall 215A, which requires no tiebacks or deadman. The cantilevered seawall 215A is advantageously self-supporting (e.g., in the earth into which the seawall is driven during installation) and can advantageously allow for a wider slip 205 or boat garage opening and allow the home and/or nautical garage 200 to be constructed closer to setback limitations (e.g., without encroaching on a neighboring property because tiebacks and deadman are not required). The boat slip 205 is also defined by a sidewall 215B parallel to the cantilevered sidewall 215A, and a back wall 215C. The sidewall 215B and back wall 215C can optionally be coupled via tiebacks to a concrete deadman, as shown in FIGS. 8C-8D. Accordingly, in this embodiment, the boat slip 205 is defined by a cantilevered seawall and conventional walls with tiebacks to deadman. In still another embodiment, the boat slip 205 can be defined only by cantilevered walls. The cantilevered wall 215A can be a precast concrete sheet pile seawall with a concrete cap 216 (e.g., a cast-in-place concrete cap).

Figure 8E:
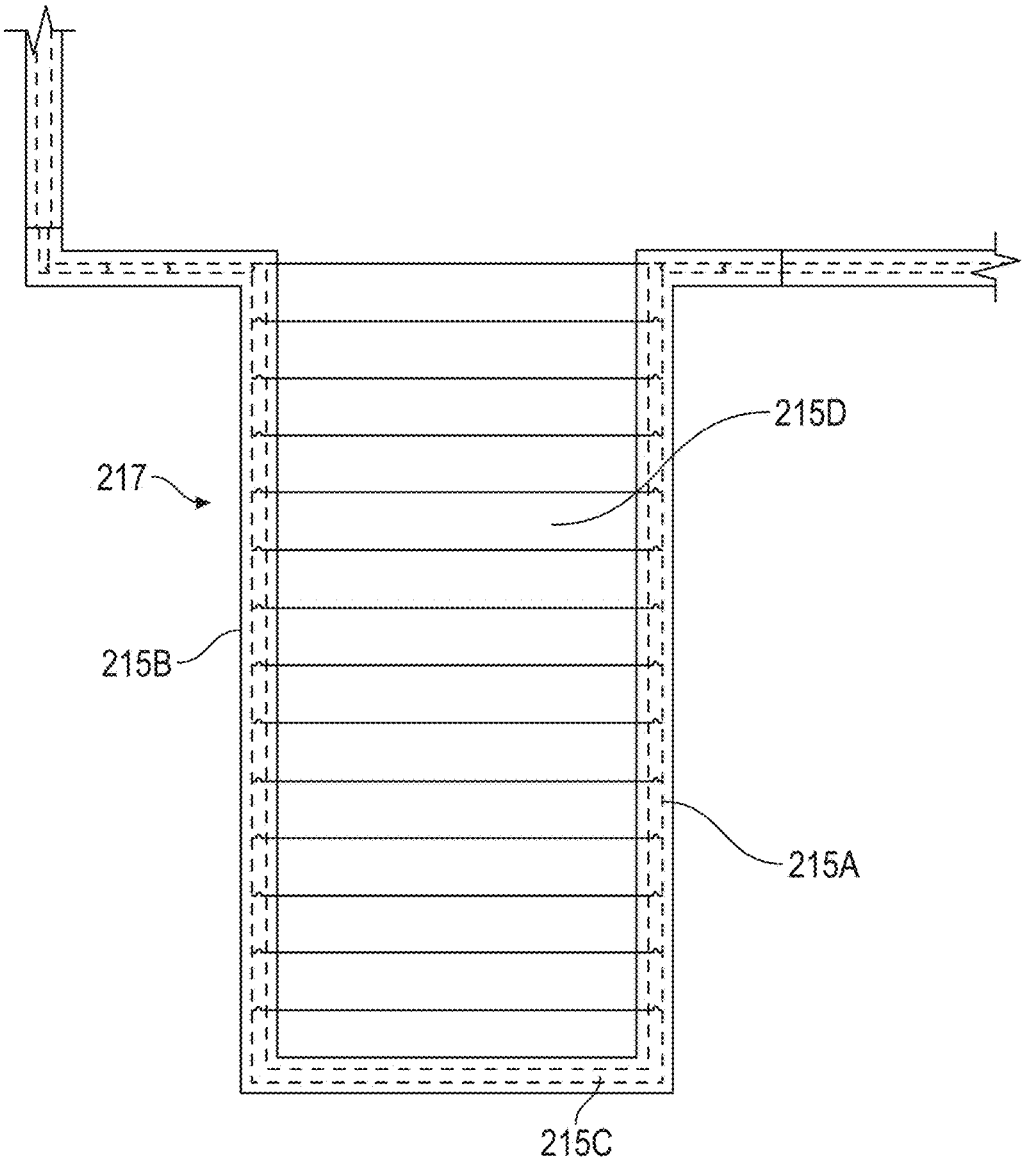
FIG. 8E is a scale drawing showing a top view of another embodiment of a nautical garage seawall design for use with the home structure with an integrated boat slip and nautical garage
Figure 8F:
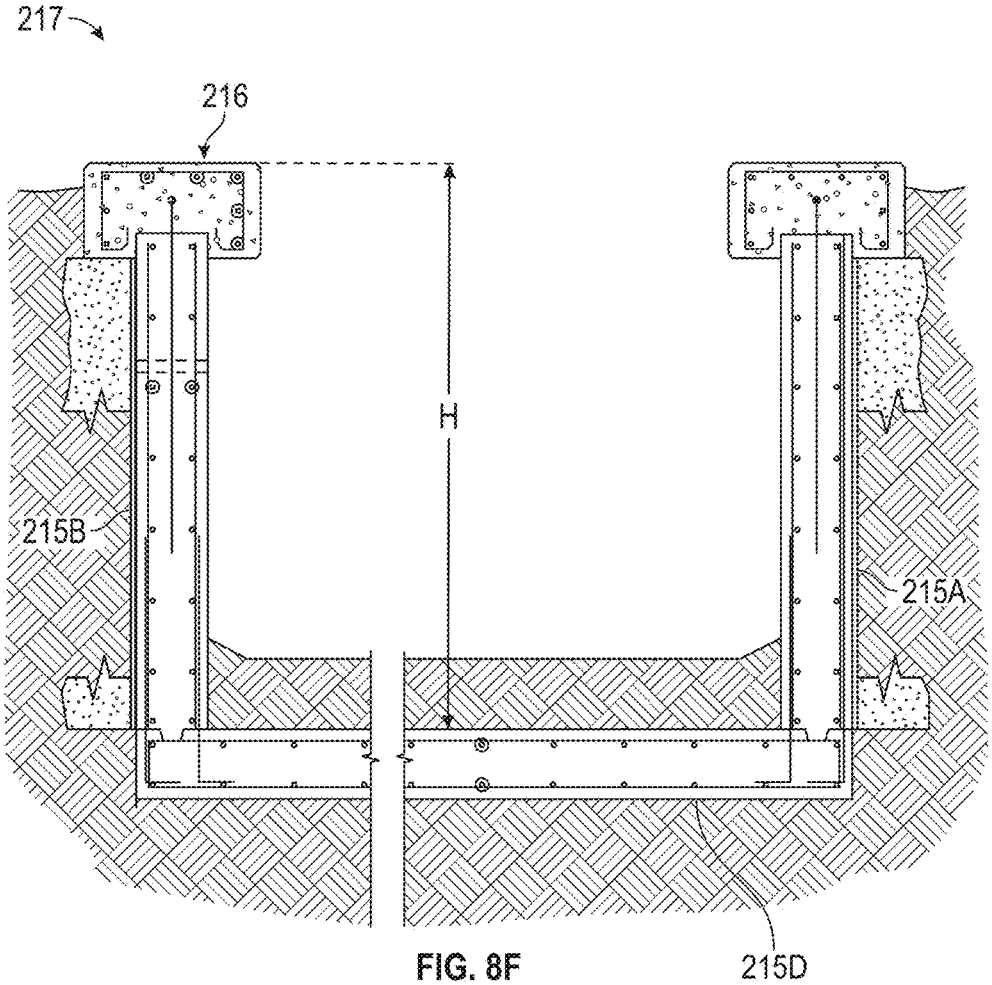
FIG. 8F is a scale drawing showing a sectional view of the nautical garage seawall design of FIG. 8E
Figure 8G:
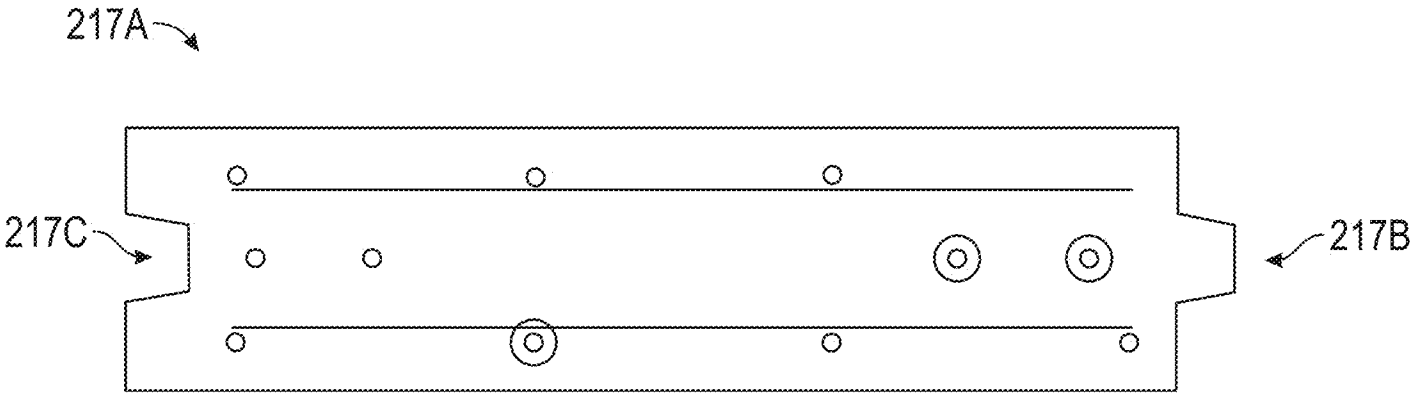
FIG. 8G is a scale drawing showing a cross-sectional view of a culvert wall segment.

FIGS. 8E-8G show another embodiment of boat slip 205 design for the nautical garage 200. In the illustrated embodiment, the seawall is defined by one or more upside down (e.g., a plurality of) U-shaped culverts 217 with an open top that together define a first seawall 215A, a second seawall 215B and a back wall 215C. One or more cross-beams 215D interconnect the first and second sidewalls 215A, 215B for each culvert 217 (see FIG. 8F). Advantageously, the U shaped culvert design reduces installation time and expense since the sidewalls 215A, 215B are set in place (e.g., and interconnected to the cross-beams 215D) instead of being driven or jetted into place, as is the case for example with cantilevered seawalls. Additionally, the integrated seawall design (e.g., defined by the first and second seawalls 215A, 215B, back wall 215C, and floor or cross-beams 215D) advantageously supports the seawater pressure without requiring the use of tie backs or deadman to secure the first, second and/or back seawalls 215A, 215B, 215C, leading to reduced installation time for the integrated seawall design. Further, the boat slip 215 with U-shaped culverts 217 advantageously allows for the home and/or nautical garage 200 to be constructed closer to setback limitations (e.g., without encroaching on a neighboring property because tiebacks and deadman are not required). As with other embodiments described herein, the seawalls 215A, 215B, 215C can have a concrete cap 216 (e.g., a cast-in-place concrete cap). In some embodiments, the top of the concrete cap 216 is generally level with the floor F in the nautical garage 200. Accordingly, in this embodiment, the boat slip 205 is defined by a U-shaped culvert seawall design. Optionally, in another embodiment, one or more of the first, second or back seawalls 215A, 215B, 215C can be further supported with tie backs attached to a support structure, such as a deadman (such as deadman 220 in FIG. 8D). With continued reference to FIGS. 8E-8F, each of the culverts 217 can have a width 217*a* of about 4 feet and depth D of about 1 foot. In other embodiments, the width 217*a* can have different values longer or shorter than 4 feet, and the depth D can have other suitable values. Each culvert 217 can have a key portion 217*b* on one end that can fit into a recessed portion 217*c* on an opposite end, thereby allowing multiple culverts 217 to couple to each other to define the seawalls 215A, 215B, as shown in FIG. 8E. The boat slip 205 can have a width W of about 18 feet, and length L of about 57 feet in one embodiment. In other embodiments, the width W and/or length L can have other suitable values (such as 25 feet, or those previously discussed above). The height H of the culvert 217 can be about 10 feet from a top of the cap 216 to the cross-beam 215D. However, in other embodiments, the height H can have other suitable values.

Figure 9:
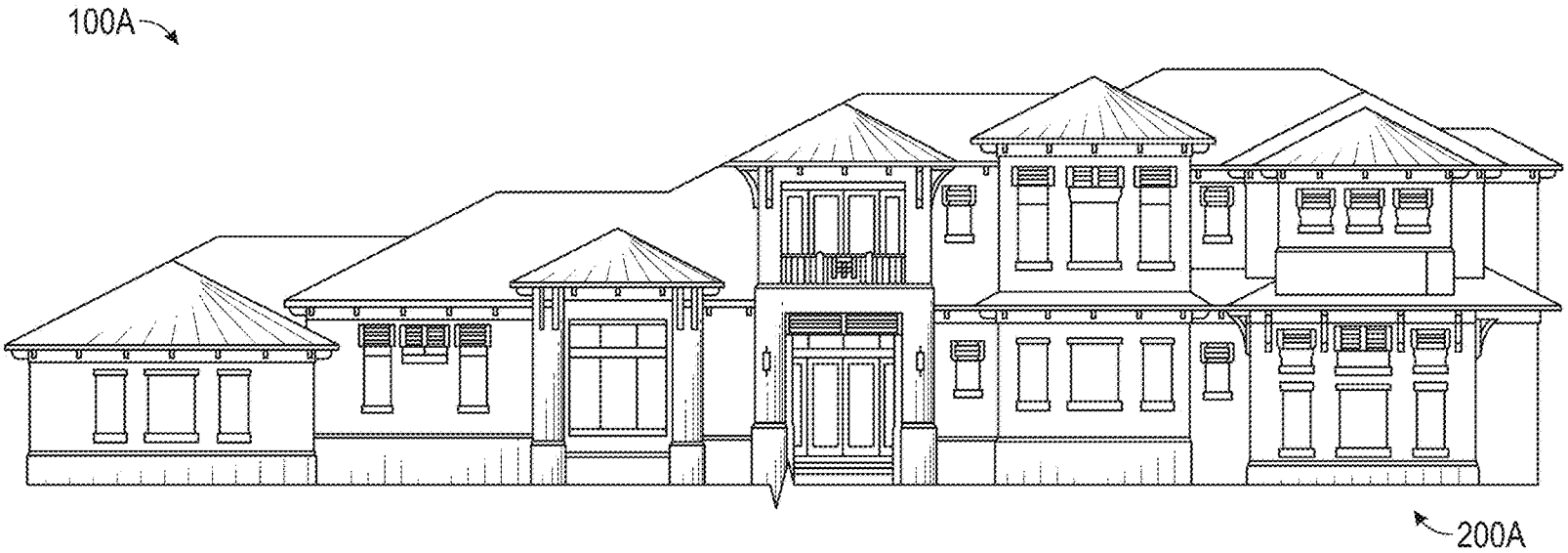
FIG. 9 is a schematic front elevation drawing of another embodiment of a home structure with an integrated boat slip and nautical garage.
Figure 10:
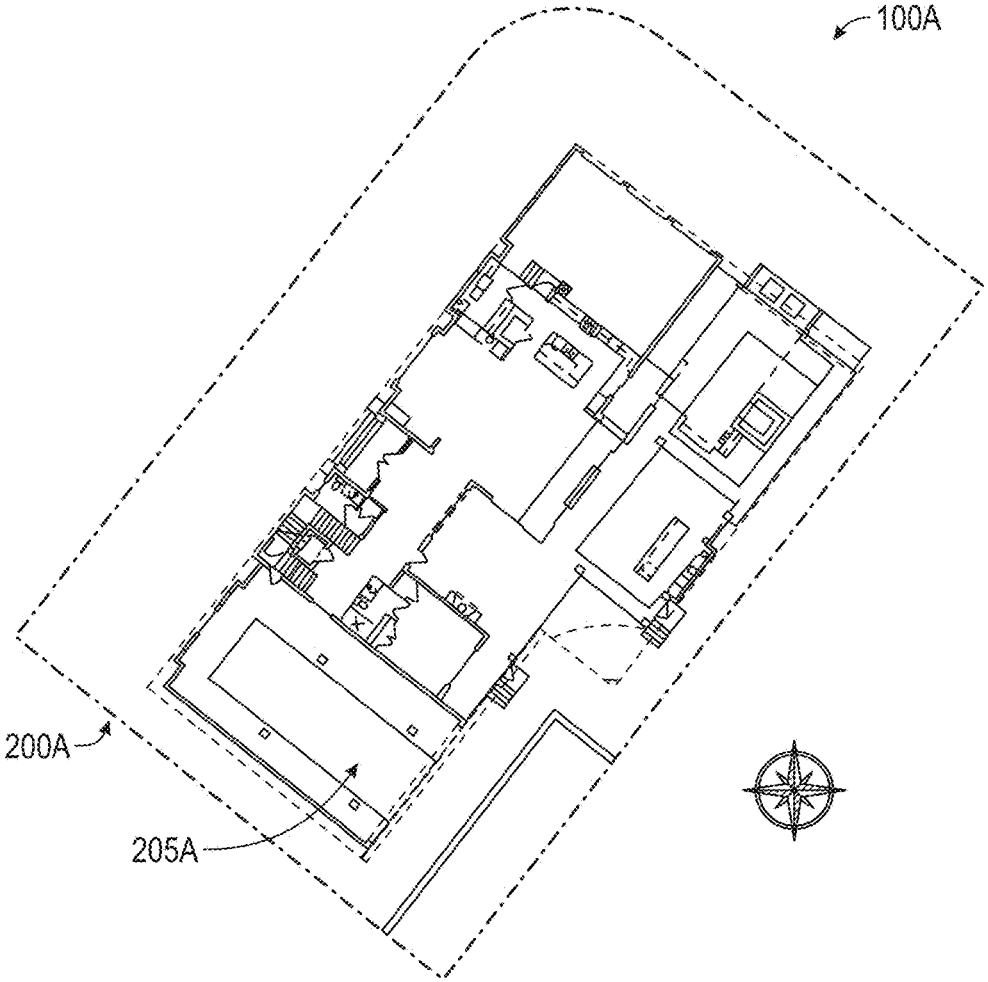
FIG. 10 is a schematic site plan view of the home structure in FIG. 9.
Figure 11:
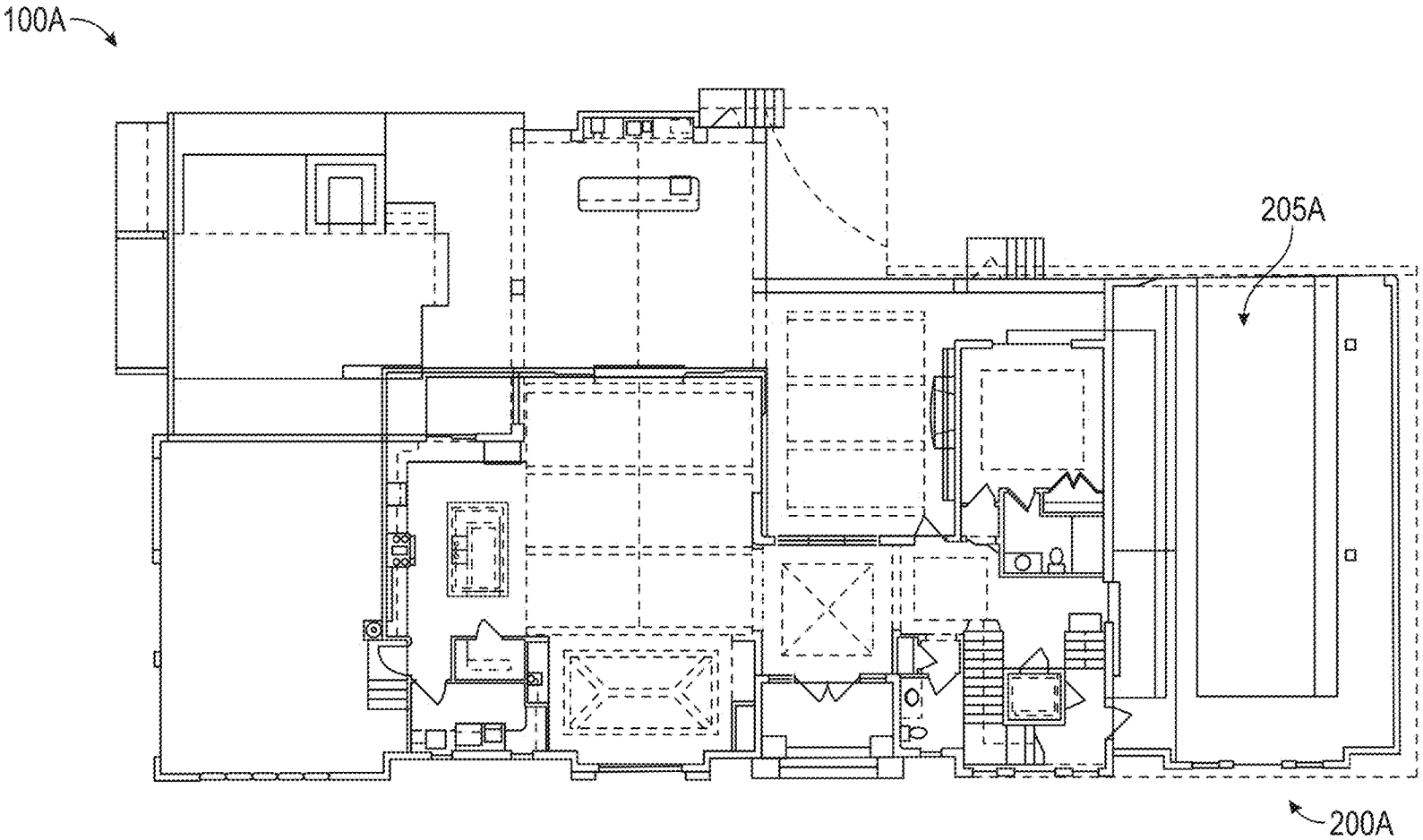
FIG. 11 is a schematic drawing showing a plan view of a first floor of the home structure of FIG. 9 with the integrated boat slip and nautical garage.
Figure 12:
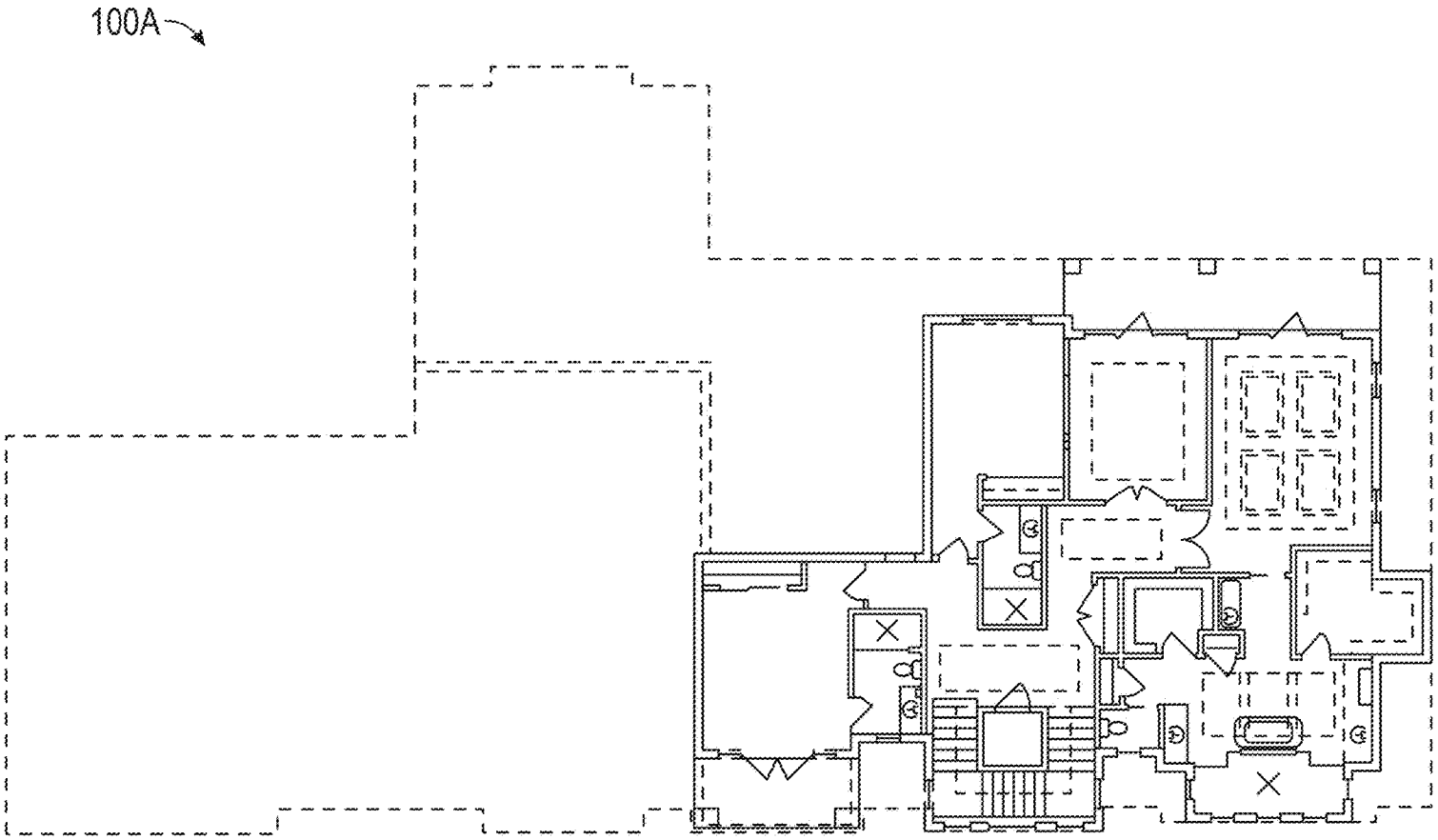
FIG. 12 is a scale drawing showing a plan view of a second floor of the home structure of FIG. 9 with the integrated boat slip and nautical garage.

FIGS. 9-12 show another embodiment of a home structure 100A with an integrated nautical garage 200A and boat slip 205A. FIG. 9 shows a front elevational view of the design of the home structure 100A and integrated nautical garage 200A. FIG. 10 shows a site plan view of the home structure 100A with the integrated nautical garage 200A and boat slip 205A. FIG. 11 shows a plan view of a first floor of the home structure 100A with the integrated nautical garage 200A and boat slip 205A. FIG. 12 shows a plan view of a second floor of the home structure 100A with the integrated nautical garage 200A. As with the home structure 100 described above, the home structure 100A with the integrated nautical garage 200A can have a lift mechanism (like the lift mechanism 210 described above), and a roll down door and/or shutter to close off the nautical garage. Additionally, the lift mechanism can optionally include a no profile deck that can align (e.g., sit flush with) the floor or decking in the nautical garage 200A so as to provide an even walking surface about the boat when fully raised for storage within the nautical garage 200A. One of skill in the art will recognize that the same features described above in connection with the home structure 100 (e.g., the use of a cantilevered sea wall, etc.) can be incorporated into the design of the home structure 100A with the integrated nautical garage 200A.

Advantageously, the seawall design embodiments illustrated in FIGS. 6-8G advantageously use materials suitable for exposure to sea water (e.g., suitable for nautical garages at sea waterfront). Further, the embodiments of the home structure with integrated nautical garage and boat slip disclosed above advantageously allow users to easily access the boat B from the living quarters in the home structure 100 without exiting the home structure (e.g., without being exposed to the weather). Additionally, the embodiments described herein for a home structure with integrated nautical garage and boat slip allow for the boat to be protected from the elements (e.g., salt water, wind, rain, UV rays from the sun) by housing the boat within the nautical garage and raising it out of the water using the lift mechanism.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A residential home, comprising:

a structure set back from a water's edge and defining one or more living spaces; and a nautical garage integrated with the structure and accessible via at least one of the living spaces without a user having to exit the structure, the nautical garage comprising a boat slip set back from a water's edge and disposed under the nautical garage, the boat slip defined by one or more seawalls and sized to receive a boat therein, the boat slip comprising a plurality of U-shaped culverts coupled to each other that define the sea walls of the boat slip, each of the U-shaped culverts comprising a left wall segment, a right wall segment and a cross-beam that interconnects the right wall segment and left wall segment and defines a bottom wall segment of the culvert, and a lift mechanism disposed in the boat slip and configured to be actuated to move a boat into and out of water while in the boat slip.

2. The residential home of claim 1, wherein the boat slip is self-supporting.

3. The residential home of claim 1, wherein each of the U-shaped culverts is approximately 4 feet in length.

4. The residential home of claim 1, wherein each of the U-shaped culvert has a protrusion on one side and a recess on an opposite side, wherein the protrusion is configured to extend into a recess of an adjacent U-shaped culvert to couple the culverts together.

5. The residential home of claim 1, wherein each of the U-shaped culverts comprises precast concrete segments.

6. The residential home of claim 1, further comprising a cast-in-place concrete cap disposed on a top end of the sea walls of the boat slip, a top of the cap being generally at a same level as a floor of the nautical garage.

7. The residential home of claim 1, wherein at least one of the one or more seawalls of the boat slip is a cantilevered seawall that is self-supporting.

8. The residential home of claim 1, wherein at least one of the sea walls of the boat slip is connected to a deadman via one or more tie backs, such that the deadman and one more tie backs support the at least one sea wall in place.

9. The residential home of claim 1, wherein the lift mechanism is mounted to one or more of the sea walls of the boat slip via one or more brackets that support the lift mechanism in place.

10. A residential home, comprising:

a structure set back from a water's edge and defining one or more living spaces; and a nautical garage integrated with the structure and accessible via at least one of the living spaces without a user having to exit the structure, the nautical garage comprising a boat slip set back from a water's edge and disposed under the nautical garage, the boat slip defined by a left sea wall, a right seawall and a rear sea wall, the boat slip sized to receive a boat therein, the boat slip comprising a plurality of U-shaped culverts coupled to each other that define the left, right and rear sea walls of the boat slip, each of the U-shaped culverts comprising a left wall segment, a right wall segment and a cross-beam that interconnects the right wall segment and left wall segment and defines a bottom wall segment of the culvert and a lift mechanism disposed in the boat slip and configured to be actuated to move a boat into and out of water while in the boat slip.

11. The residential home of claim 10, wherein the boat slip is self-supporting.

12. The residential home of claim 10, wherein each of the U-shaped culvert has a protrusion on one side and a recess on an opposite side, wherein the protrusion is configured to extend into a recess of an adjacent U-shaped culvert to couple the culverts together.

13. The residential home of claim 10, wherein each of the U-shaped culverts comprises precast concrete segments.

14. The residential home of claim 10, further comprising a cast-in-place concrete cap disposed on a top end of the left, right and rear sea walls of the boat slip, a top of the cap being generally at a same level as a floor of the nautical garage.

15. The residential home of claim 10, wherein at least one of the left and right seawalls of the boat slip is a cantilevered seawall that is self-supporting.

16. The residential home of claim 10, wherein at least one of the left, right and rear sea walls of the boat slip is connected to a deadman via one or more tie backs, such that the deadman and one more tie backs support said at least one sea wall in place.

17. The residential home of claim 10, wherein the lift mechanism is mounted to one or more of the left and right sea walls of the boat slip via one or more brackets that support the lift mechanism in place.

* * * * *